US006698916B2

(12) United States Patent
Araoka

(10) Patent No.: US 6,698,916 B2
(45) Date of Patent: Mar. 2, 2004

(54) UNDERWATER AGITATION PUMP

(75) Inventor: Toshinobu Araoka, Kitakyushu (JP)

(73) Assignee: Toyo Denki Industrial Co., Ltd., Fukuoka (JP)

( * ) Notice: Subject to any disclaimer, the term of this patent is extended or adjusted under 35 U.S.C. 154(b) by 75 days.

(21) Appl. No.: 09/933,126

(22) Filed: Aug. 21, 2001

(65) Prior Publication Data

US 2002/0191488 A1 Dec. 19, 2002

(30) Foreign Application Priority Data

Jun. 19, 2001 (JP) ..... 2001-185521

(51) Int. Cl.[7] ..... B01F 5/12
(52) U.S. Cl. ..... 366/264; 417/423.3; 417/423.9
(58) Field of Search ..... 417/423.1, 423.3, 417/423.9; 366/262, 263, 264; 415/143

(56) References Cited

U.S. PATENT DOCUMENTS 1,668,063 A * 5/1928 Force
1,769,257 A * 7/1930 Demaree
2,376,071 A * 5/1945 Miess
2,555,619 A * 6/1951 Vincent
2,622,858 A * 12/1952 Hughes
2,701,529 A * 2/1955 Finzel
3,694,110 A * 9/1972 Guinard
3,718,957 A * 3/1973 Shank
3,791,757 A * 2/1974 Tarifa et al.
4,456,424 A * 6/1984 Araoka
4,460,181 A * 7/1984 Araoka
4,728,256 A * 3/1988 Araoka
5,005,364 A * 4/1991 Nelson

FOREIGN PATENT DOCUMENTS

GB 2 070 687 A * 9/1981
JP 53-30652 3/1979
JP 10-9182 A * 1/1998
JP 2001-40695 A * 2/2001

* cited by examiner

*Primary Examiner*—Charles E. Cooley
*Assistant Examiner*—David Sorkin
(74) *Attorney, Agent, or Firm*—Browdy and Neimark, P.L.L.C.

(57) ABSTRACT

An underwater agitation pump comprises an impeller casing in which an impeller driven by a motor is rotatably accommodated, an agitated material suction guide cylinder of a hollow cylinder which has one-end opening portion thereof integrally communicably connected to a center suction opening portion of the impeller while passing through a center opening of the impeller casing and having the other-end opening portion thereof extended downwardly, the suction guide cylinder further forming an agitated material suction passage therewithin, and an agitator mounted on an outer peripheral portion of the other-end opening portion of the agitated material suction guide cylinder. Due to such a constitution, the agitated material suction passage formed in the inside of the agitated material suction guide cylinder can ensure a sufficiently wide agitated material inflow area.

9 Claims, 9 Drawing Sheets

UNDERWATER AGITATION PUMP

BACKGROUND OF THE INVENTION (1) Field of the Invention

The present invention relates to an underwater agitation pump which can suck soil, sand or the like which contains block-like material or string-like material in a dredging site, civil engineering work site, a sewage treatment plant, a sedimentation pool or a pit within a plant, an inside of a manhole or the like while efficiently agitating such soil, sand or the like and can discharge such sand, soil or the like to a given place.

(2) Description of the Related Art

Conventionally, as an underwater agitation pump which is served for the above-mentioned usage, there has been known an underwater agitation pump 100 which has a constitution shown in FIG. 19, for example.

As shown in the drawing, in this underwater agitation pump 100, an impeller casing 101 having a hollow disc-like shape is provided with a center suction opening portion 102 at a center portion of a lower surface thereof and a discharge opening portion 104 which is connected to a discharge pipe 103 at a peripheral portion thereof. In the inside of the impeller casing 101, a disc-like impeller 105 is rotatably disposed. The impeller 105 is provided with a center suction opening portion 106 at a center portion of a lower surface thereof and forms a plurality of radial flow passages 107 in the inside thereof in a circumferentially spaced-apart manner. Further, the impeller 105 is fitted on and is connected to an output shaft 109 of a water-tight motor 108 which is mounted on an upper surface of the impeller casing 101.

Further, a cylindrical strainer 111 having a bottom wall 110 is contiguously mounted on a lower portion of the impeller casing 101 and an annular support frame 112 is mounted on a lower surface of the cylindrical strainer 111.

Still further, the output shaft 109 of the water-tight motor 108 to which the impeller 105 is fixedly secured is extended downwardly after passing through the center suction opening portion 106 of the impeller 105, the center suction opening portion 102 of the impeller casing 101 and the cylindrical strainer 111 and forms an agitator mounting shaft 113. An agitator (cutter fan) 114 which protrudes a plurality of blade members in the radial direction from an outer peripheral surface of a body thereof is fixedly secured to a distal end of the agitator mounting shaft 113.

Due to such a constitution, when the watertight motor 108 is driven, the impeller 105 and the agitator 114 are integrally rotated so that a negative pressure is generated in the inside of the impeller casing 101 and soil, sand or the like which is piled up below the underwater agitation pump 100 is agitated by the agitator 114. Accordingly, the agitated soil, sand or the like is sucked into the impeller casing 101 through the cylindrical strainer 111 and thereafter is discharged to a desired place through the discharge opening portion 104 and the discharge pipe 103.

However, the above-mentioned underwater agitation pump 100 still has a following task to be solved. That is, as shown in FIG. 19, the agitator mounting shaft 113 which mounts the agitator 114 on the distal end thereof passes through the center suction opening portion 106 of the impeller 105 and the center suction opening portion 102 of the impeller casing 101. Accordingly, as shown in FIG. 20, a soil/sand inflow effective area A2 is formed of a narrow annular area which is defined between an inner peripheral surface of the center suction opening portion 106 or the center suction opening portion 102 and an outer peripheral surface of the agitator mounting shaft 113.

Accordingly, when block-like material or string-like material is mixed in the soil, sand or the like, such string-like material or flexible cloths such as vinyl cloths or the like are entangled in the agitator 114, the agitator mounting shaft 113, the cylindrical strainer 111 or the like and the block-like material and the string-like material clog the soil/sand inflow effective area A2. As a result, the operation of the underwater agitation pump becomes difficult or impossible so that there is a possibility that the soil/sand suction operation becomes difficult or impossible.

The present invention has been made to solve such a drawback and it is an object of the present invention to provide an underwater agitation pump which can reliably and efficiently suck and discharge soil, sand or the like even when the sand, soil or the like includes block-like material or string-like material.

SUMMARY OF THE INVENTION

To achieve the above-mentioned object, according to a first aspect of the present invention, there is provided an underwater agitation pump which comprises an impeller casing in which an impeller driven by a motor is rotatably accommodated, an agitated material suction guide cylinder being constituted of a hollow cylinder which has one-end opening portion thereof integrally connected to a center suction opening portion of the impeller while passing through a center opening of the impeller casing and having the other-end opening portion thereof extended downwardly, the agitated material suction guide cylinder further forming an agitated material suction passage in the inside thereof, and an agitator which is mounted on an outer periphery of the other-end opening portion of the agitated material suction guide cylinder.

In the above-mentioned constitution, a proximal end of the agitated material suction guide cylinder which is formed of the hollow cylinder is directly communicably connected with the center suction opening portion of the impeller and the agitator is mounted on the outer peripheral portion of the distal end of the agitated material suction guide cylinder. Accordingly, it becomes possible to make an inner diameter of the agitated material suction guide cylinder substantially equal to an inner diameter of the center suction opening portion of the impeller and an agitator mounting shaft which has been necessary in a conventional underwater agitation pump is made unnecessary, whereby the agitated material suction passage formed in the inside of the agitated material suction guide cylinder can ensure a sufficiently wide agitated material inflow area. Accordingly, it becomes possible to sufficiently agitate soil, sand or the like in which block-like material or string-like material is mixed with use of the agitator and, at the same time, it is possible to smoothly suck such soil, sand or the like in which the block-like material or the string-like material is mixed into the impeller casing through the agitated material suction guide cylinder.

Further, since it becomes possible to make an outer diameter of the agitated material suction guide cylinder substantially equal to the inner diameter of the center suction opening portion of the impeller, compared to the agitator mounting shaft of the conventional underwater agitation pump which mounts an agitator on a distal end thereof, the outer diameter of the agitated material suction guide cylinder can be remarkably increased so that the winding or the wrapping of the string-like material around the agitated material suction guide cylinder can be reliably prevented. Further, compared to the agitator mounting shaft of the conventional underwater agitation pump, the outer diameter of the agitated material suction guide cylinder can be remarkably increased and hence, the section modulus can be remarkably increased so that the mechanical strength of the agitated material suction guide cylinder can be increased whereby it becomes possible to increase the agitator supporting strength and to prevent the rapture or the like of the agitated material suction guide cylinder reliably.

Still further, since the other-end opening portion of the agitated material suction guide cylinder which forms an suction opening of the agitated material is formed at a position which is downwardly protruded from the center suction opening portion of the impeller, such a suction opening can be located close to a waterbed compared to an agitated material suction opening of the conventional underwater agitation pump. Accordingly, it becomes possible to simultaneously perform the agitation and the suction of sediment (agitated material). In this manner, while ensuring the sufficiently wide agitated material inflow area in the inside of the agitated material suction guide cylinder, the suction efficiency of the sediment (agitated material) can be further enhanced.

Although the agitated material suction guide cylinder can be formed with the impeller by an integral molding, the agitated material suction guide cylinder can be formed as a body separate from the impeller and can be connected to the impeller by means of bolts. Further, the agitated material suction guide cylinder is formed as a body separate from the impeller, a female threaded portion is formed in the center suction opening portion of the impeller, a male threaded portion is formed in the one-end opening portion of the agitated material suction guide cylinder, and the agitated material suction guide cylinder is connected to the impeller by engaging the male threaded portion with the female threaded portion. In this manner, when the agitated material suction guide cylinder is constituted of a member separate from the impeller, the constitutions of the impeller and the agitated material suction guide cylinder can be simplified so that they can be manufactured at a low cost.

The agitated material suction guide cylinder may be comprised of a large-diameter body portion and a stepped distal-end narrowed-diameter portion which constitutes the other-end opening portion, and the agitator is formed by mounting a plurality of triangular agitator constituting members which are extended in the radial direction in a circumferentially spaced apart manner on a stepped portion of the stepped distal-end narrowed-diameter portion. In this case, the agitator constituting members plays a role of guides for the string-like material so that the entanglement of the string-like material in the agitator can be further reliably prevented.

Although the agitator may be mounted on the outer peripheral portion of the other-end opening portion of the agitated material suction guide cylinder by welding or the like, the agitator may be integrally formed with the agitated material suction guide cylinder by molding the other-end opening portion of the agitated material suction guide cylinder in a non-circular shape (triangular shape, quadrangular shape, polygonal shape, star-like shape or the like). In this case, since the agitator can be integrally formed with the agitated material suction guide cylinder, the agitator supporting strength can be increased. Further, since the agitated material suction guide cylinder and the agitator can be integrally formed, manufacturing steps can be decreased in number so that they can be manufactured at a low cost.

A helical feeding blade may be mounted on an inner surface of the agitated material suction guide cylinder. In this case, along with the rotation of the agitated material suction guide cylinder, the helical feeding blade is integrally rotated so as to generate a lifting force so that the suction efficiency of the underwater agitation pump can be enhanced. Accordingly, even when the agitated material may be made of material having a high-concentration (soil, sand, muddy water or the like of low fluidity having a small water content), the agitated material can be efficiently and reliably sucked.

A sub water supply pipe which has an upper inlet opening thereof opened in water may have a lower outlet opening thereof disposed in the vicinity of the agitator and directed toward the agitator. In this case, even when the concentration of the soil, sand or the like is excessively high, the soil, sand or the like can be diluted with the sub water so that the soil, sand or the like can be made to smoothly flow into the inside of the agitated material suction guide cylinder.

A peripheral wall for preventing collapsing and inflow of soil, sand or the like which concentrically surrounds the agitated material suction guide cylinder and has a lower end thereof opened may be contiguously connected to a lower portion of the impeller casing, a water reservoir space may be formed between the agitated material suction guide cylinder and the peripheral wall for preventing collapsing and inflow of soil, sand or the like, and a lower outlet opening of a sub water supply pipe which has an upper inlet opening thereof opened in water may be communicably connected to the water reservoir space. In this case, due to the presence of the peripheral wall for preventing collapsing and inflow of soil, sand or the like, it becomes possible to prevent soil, sand or the like from being collapsed and clogging the other-end opening portion of the agitated material suction guide cylinder which forms a suction opening of the agitated material. Further, due to the presence of the water reservoir space, the soil, sand or the like having a high-concentration can be agitated while being diluted with the sub water and thereafter can be made to smoothly flow into the inside of the agitated material suction guide cylinder.

Further, to achieve the above-mentioned object, according to a second aspect of the present invention, there is provided an underwater agitation pump which comprises an impeller casing in which an impeller driven by a motor is rotatably accommodated, an agitated material suction guide cylinder being constituted of a hollow cylinder which has one-end opening portion thereof integrally connected to a center suction opening portion of the impeller while passing through a center opening of the impeller casing and having the other-end opening portion thereof extended downwardly, the agitated material suction guide cylinder further forming an agitated material suction passage in the inside thereof, a strip-like agitator mounting member which spans the other-end opening portion of the agitated material suction guide cylinder, and an agitator which is fixedly secured to a center portion of the agitator mounting member, wherein portions which constitute the other-end opening portion of the agitated material suction guide cylinder and are disposed at both sides of the agitator mounting member are notched toward the impeller to form a pair of agitated material suction openings.

Also according to this aspect of the present invention, the agitation of soil, sand or the like by the agitator and the suction of the soil, sand or the like by the impeller can be simultaneously performed so that the suction and discharge efficiency can be enhanced. Further, since a pair of agitated material suction openings are formed at both sides of the agitator mounting member, the soil, sand or the like which contains the string-like material or the block-like material can be smoothly sucked into the impeller casing through the agitated material suction openings and thereafter can be discharged from the impeller casing.

DETAILED DESCRIPTION OF THE PREFERRED EMBODIMENTS

The present invention is specifically explained hereinafter in reference to embodiments shown in attached drawings.

First Embodiment

Figure 1:
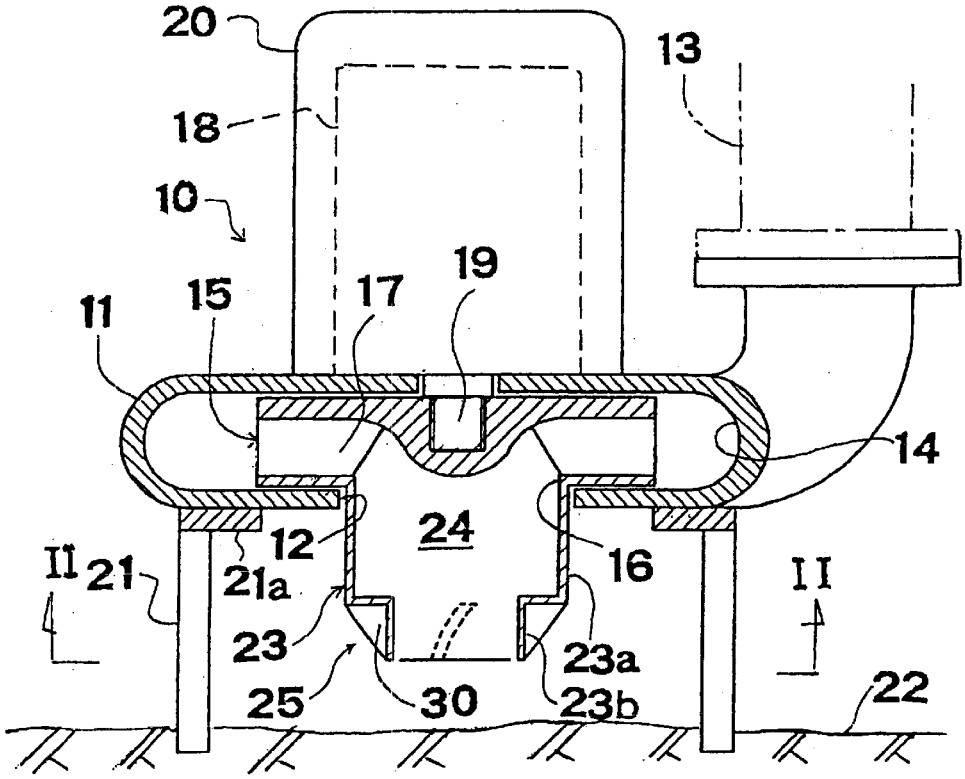
FIG. 1 is a front view with a part in cross section of an underwater agitation pump according to the first embodiment of the present invention.
Figure 2:
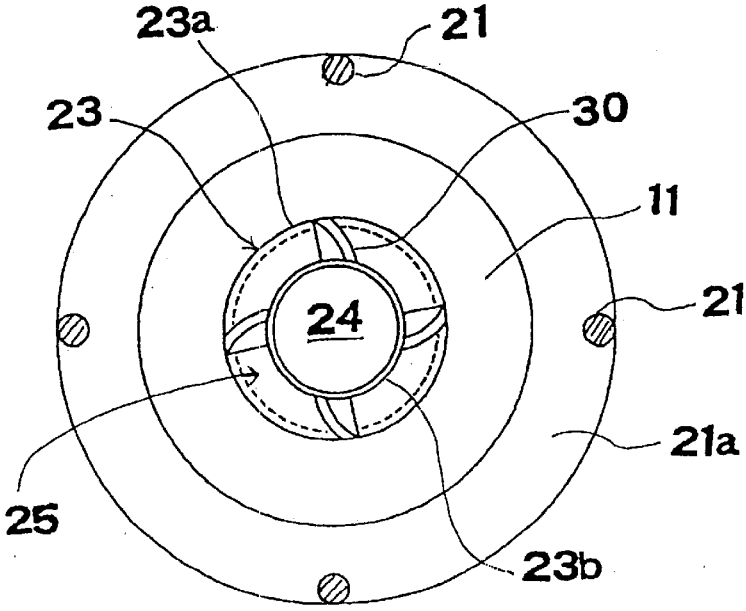
FIG. 2 is a bottom plan view as viewed from a line I—I of FIG. 1 in an arrow direction.
Figure 3:
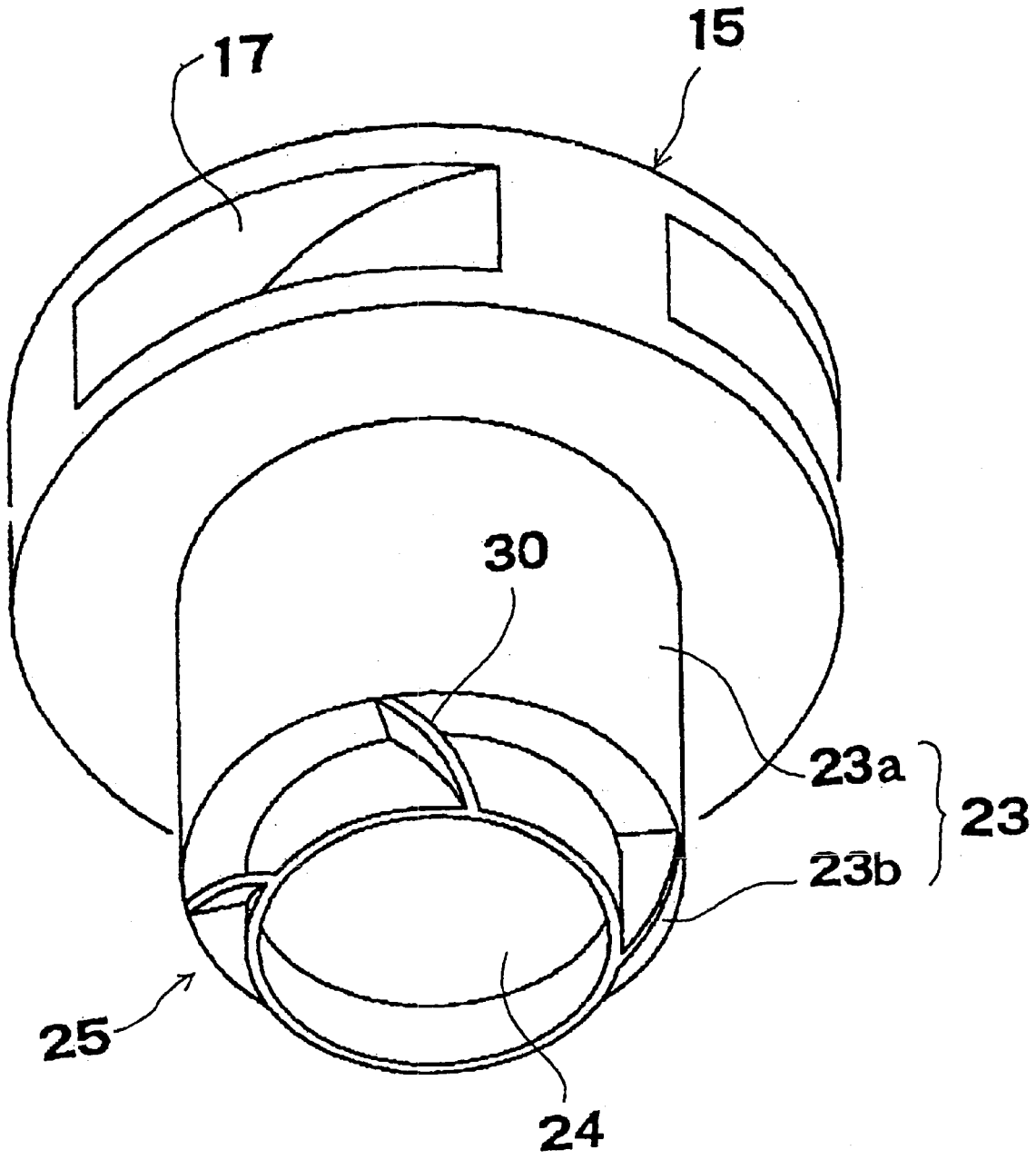
FIG. 3 is a perspective view of an impeller and an agitated material suction guide cylinder as viewed from below.

An underwater agitation pump 10 according to the first embodiment of the present invention is shown in FIG. 1 to FIG. 3. Here, FIG. 1 is a front view with a part in section of the underwater agitation pump 10 according to the first embodiment of the present invention, FIG. 2 is a cross-sectional view of FIG. 1 taken along a line I—I, and FIG. 3 is a perspective view showing an impeller, an agitated material suction guide cylinder and an agitator which constitute essential parts of the underwater agitation pump 10.

First of all, to explain the whole constitution of the underwater agitation pump 10, an impeller casing 11 having a hollow disc-like shape is provided with a circular center opening 12 at a center portion of a lower surface thereof and a discharge opening portion 14 which is connected to a discharge pipe 13 at a peripheral portion thereof. In the inside of the impeller casing 11, a disc-like impeller 15 is rotatably disposed. The impeller 15 is provided with a circular center suction opening portion 16 at a center portion of a lower surface thereof and a plurality of radial passages 17 are formed in the inside of the impeller 15 in a circumferentially spaced-apart manner. Further, the impeller 15 is fitted on and connected to an output shaft 19 of a watertight motor 18 which constitutes a drive source and is mounted on an upper surface of the impeller casing 11. Here, numeral 20 indicates a motor casing and numeral 21 indicates a support base having a mounting frame 21*a* which is served for mounting and supporting the underwater agitation pump 10 on a bottom surface 22 made of soil, sand or the like.

Further, an agitated material suction guide cylinder 23 which is constituted of a circular hollow cylinder is disposed concentrically below the impeller casing 11. The agitated material suction guide cylinder 23 has one-end opening portion thereof pass through the center opening 12 of the impeller casing 11 and integrally and communicably connected with the center suction opening portion 16 of the impeller 15 and the other-end opening portion thereof extended downwardly. An agitated material suction passage 24 is formed in the inside of the agitated material suction guide cylinder 23.

Further, an agitator 25 which is served for agitating the soil, sand or the like is mounted on an outer peripheral portion of the other-end opening portion of the agitated material suction guide cylinder 23.

With respect to the agitated material suction guide cylinder 23 having the above-mentioned constitution, the diameter (inner diameter) of the agitated material suction guide cylinder 23 can be made substantially equal to the diameter (inner diameter) of the center suction opening portion 16 of the impeller 15 and hence, the agitated material suction guide cylinder 23 can form the agitated material suction passage 24 having the sufficiently large diameter (inner diameter), that is, the sufficiently wide space in the inside thereof.

Figure 4:
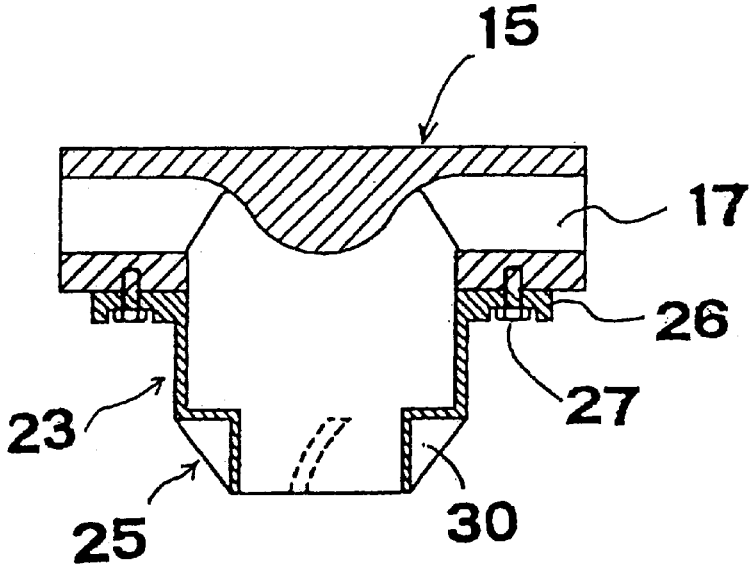
FIG. 4 is an explanatory view showing the connection state between the impeller and the agitated material suction guide cylinder.
Figure 5:
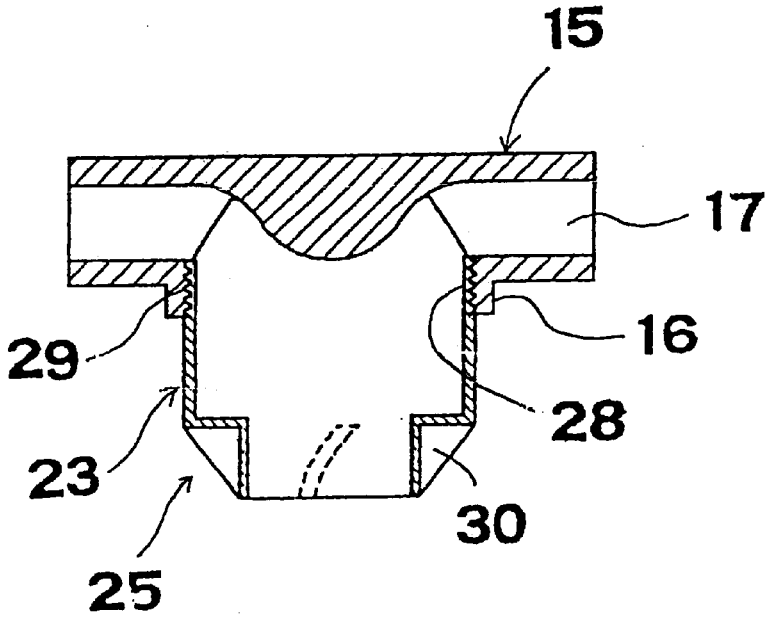
FIG. 5 is an explanatory view showing the connection state between the impeller and the agitated material suction guide cylinder.

Further, in this embodiment, the agitated material suction guide cylinder 23 is formed with the impeller 15 by an integral molding as shown in FIG. 1 and FIG. 3. However, as shown in FIG. 4, the agitated material suction guide cylinder 23 can be mounted on the impeller 15 such that the agitated material suction guide cylinder 23 is formed as a body separate from the impeller 15, a flange 26 is integrally mounted on an outer peripheral surface of one-end opening portion of the agitated material suction guide cylinder 23, and the flange 26 is connected to the impeller 15 by means of bolts 27. Further, as shown in FIG. 5, the agitated material suction guide cylinder 23 may be connected to the impeller 15 such that the agitated material suction guide cylinder 23 is formed as a body separate from the impeller 15, a female threaded portion 28 is formed on the center suction opening portion 16 of the impeller 15, a male threaded portion 29 is formed on one-end opening portion of the agitated material suction guide cylinder 23, and the male threaded portion 29 is engaged with the female threaded portion 28.

Further, according to this embodiment as shown in FIG. 1 to FIG. 3, the agitator 25 is constituted such that the agitated material suction guide cylinder 23 is comprised of a large diameter body portion 23*a* and a stepped distal-end narrowed-diameter portion 23*b* which constitutes the other-end opening portion, and a plurality of triangular agitator constituting members 30 which are extended in the radial direction in a circumferentially spaced-apart manner are formed on a stepped portion of the stepped distal-end narrowed-diameter portion 23*b*. Further, the agitator constituting members 30 are respectively mounted with a fixed inclination angle in the circumferential direction. Here, the inner diameter of the stepped distal-end narrowed-diameter portion 23*b* still has a sufficiently large diameter so that the agitated material containing the string-like material or the block-like material can be smoothly sucked into the inside of the agitated material suction guide cylinder 23.

Figure 6:
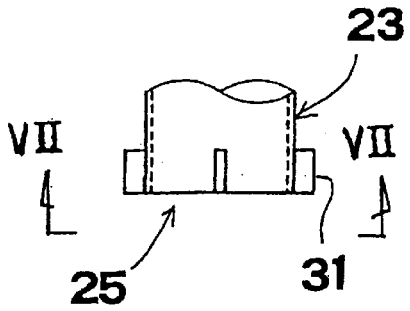
FIG. 6 is a front view of a modification of the agitator.
Figure 7:
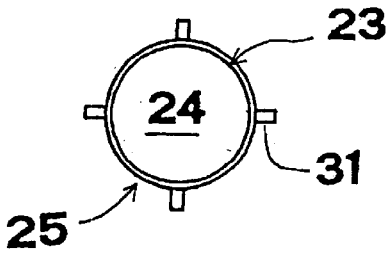
FIG. 7 is a bottom plan view of FIG. 6 as viewed from a line VII—VII in an arrow direction.
Figure 8:
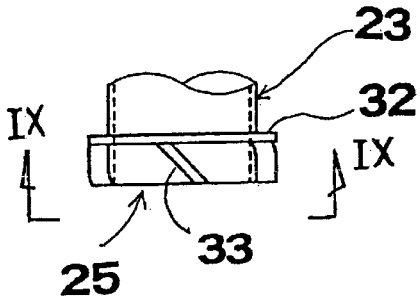
FIG. 8 is a front view of another modification of the agitator.
Figure 9:
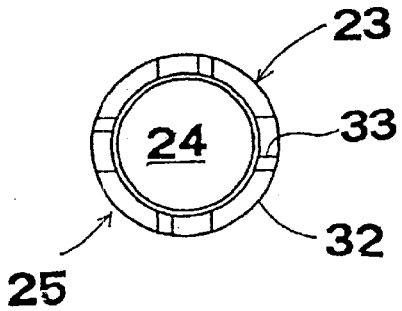
FIG. 9 is a bottom plan view of FIG. 8 as viewed from a line IX—IX in an arrow direction.
Figure 10:
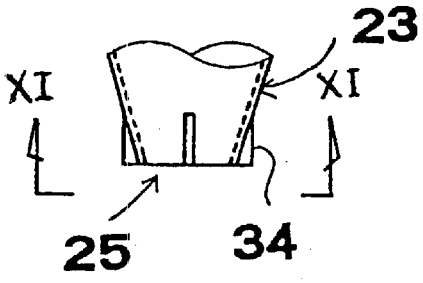
FIG. 10 is a front view of another modification of the agitator.
Figure 11:
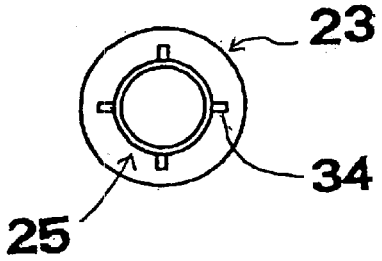
FIG. 11 is a bottom plan view of FIG. 10 as viewed from a line XI—XI in an arrow direction.

The shape or structure of the agitator 25 is not limited to those shown in FIG. 1 to FIG. 5 and various shapes and structures can be adopted in view of the nature of soil, sand or the like which forms the bottom surface 22. For example, the agitator 25 may take shapes or the structures shown in FIG. 6 to FIG. 11. The agitator 25 shown in FIG. 6 and FIG. 7 is constituted such that a plurality of agitator constituting members 31 made of rectangular lugs are mounted on the outer peripheral surface of the other-end opening portion of the agitated material suction guide cylinder 23 which is made of a straight cylinder. The agitator 25 shown in FIG. 8 and FIG. 9 is constituted such that a flange 32 is mounted on the outer peripheral surface of the other-end opening portion of the agitated material suction guide cylinder 23 which is formed of a straight cylinder and a plurality of agitator constituting members 33 which are extended radially in a circumferentially spaced-apart manner are mounted on the flange 32. Here, a plurality of agitator constituting members 33 are inclined in a circumferential direction. The agitator 25 shown in FIG. 10 and FIG. 11 is constituted such that a plurality of agitator constituting members 34 made of triangular lugs are mounted on the outer peripheral surface of the other-end opening portion of the agitated material suction guide cylinder 23 formed of a tapered cylinder which is narrowed toward a distal end thereof.

Further, although the agitator 25 can be mounted on the outer peripheral portion of the other-end opening portion of the agitated material suction guide cylinder 23 by welding or the like, the agitator 25 can be integrally formed with the agitated material suction guide cylinder 23 also by forming the other-end opening portion of the agitated material suction guide cylinder 25 in a non-circular shape (triangular shape, quadrangular shape, polygonal shape, star-like shape or the like).

Subsequently, the operation for sucking and discharging soil, sand or the like (hereinafter referred to as "soil sucking and discharging operation) using the underwater agitation pump 10 having the above-mentioned constitution is explained in conjunction with attached drawings, particularly in conjunction with FIG. 1 to FIG. 3.

When the watertight motor 18 is driven, the impeller 15 and the agitator 25 which is integrally connected to the impeller 15 by way of the agitated material suction guide cylinder 23 are rotated together. Accordingly, the inside of the impeller casing 11 becomes a negative pressure and at the same time sand, soil or the like piled up on the bottom surface 22 below the underwater agitation pump 10 is agitated by the agitator 25 and hence, the agitated material is sucked into the inside of the impeller casing 11 through the agitated material suction passage 24 formed in the inside of the agitated material suction guide cylinder 23. Thereafter, the sand, soil or the like is discharged to a desired location through the discharge opening portion 14 and the discharge pipe 13.

In such a soil sucking and discharging operation, the inner diameter of the agitated material suction guide cylinder 23 can be made approximately equal to the inner diameter of the center suction opening portion 16 of the impeller 15 and the agitator mounting shaft of the conventional underwater agitation pump can be made unnecessary and hence, the agitated material suction passage 24 formed in the inside of the hollow cylinder can have the sufficiently wide agitated material inflow area.

Accordingly, the sand, soil or the like in which the block-like material or the string-like material is mixed can be sufficiently agitated with the agitator 25 and then can be sucked into the inside of the impeller casing 11 through the agitated material suction guide cylinder 23.

Further, since the outer diameter of the agitated material suction guide cylinder 23 can be also made approximately equal to the inner diameter of the center suction opening portion 16 of the impeller 15, the agitated material suction guide cylinder 23 can ensure the remarkably large outer diameter compared to that of the agitator mounting shaft of the conventional underwater agitation pump which mounts an agitator at a distal end thereof whereby the winding or the wrapping of the string-like material around the agitated material suction guide cylinder 23 can be prevented assuredly.

Further, the other-end opening portion of the agitated material suction guide cylinder 23 which forms the suction opening for the agitated material can be located at a position protruded downwardly from the center suction opening portion 16 of the impeller 15. Accordingly, it becomes possible to make the other-end opening portion of the agitated material suction guide cylinder 23 face closer to the water bed compared to an agitated material suction opening of the conventional underwater agitation pump whereby the agitation and the suction of the sediment (agitated material) can be simultaneously performed. Coupled with the constitutional feature that the agitated material suction passage 24 can ensure the sufficiently wide agitated material inflow area, the suction efficiency of the sediment (agitated material) can be further enhanced.

Further, as shown in FIG. 1 to FIG. 5, in this embodiment, the agitator 25 is comprised of a plurality of triangular agitator constituting members 30 which are extended radially and hence, the agitator constituting members 30 play a role of guides for the string-like material whereby the winding or the wrapping of the string-like material around the agitator 25 can be prevented more assuredly.

Second Embodiment

Figure 12:
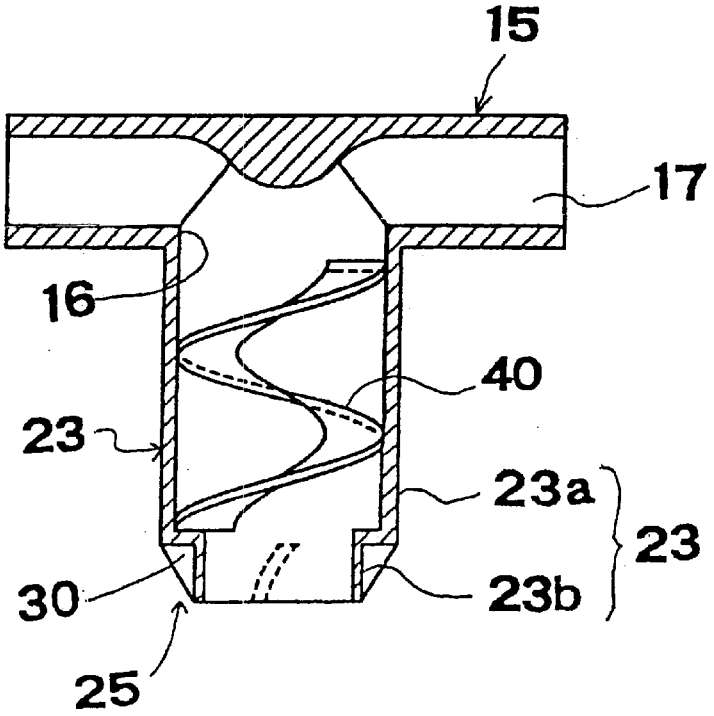
FIG. 12 is an explanatory view of an essential part of an underwater agitation pump according to the second embodiment of the present invention.

As shown in FIG. 12, this embodiment is characterized by mounting a helical feeding blade 40 on an inner surface of the agitated material suction guide cylinder 23. In this embodiment, along with the rotation of the agitated material suction guide cylinder 23, the helical feeding blade 40 is integrally rotated so that a lifting force is generated whereby the suction efficiency of the underwater agitation pump 10 can be enhanced. Accordingly, even when the agitated material is formed of agitated material having a higher concentration (soil, sand, muddy water or the like which has a little water content and a low fluidity), the agitated material can be efficiently and reliably sucked.

Third Embodiment

Figure 13:
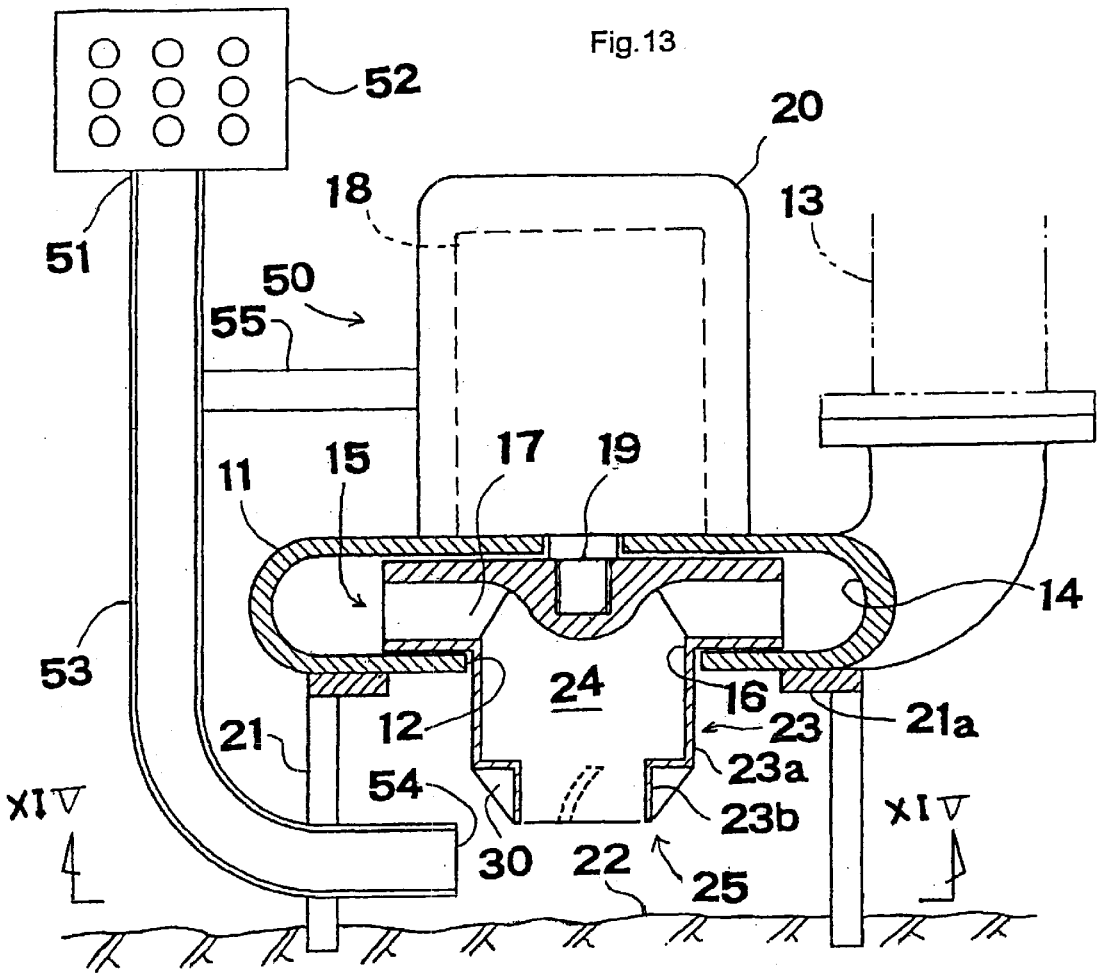
FIG. 13 is a front view with a part in cross section of an underwater agitation pump according to the third embodiment of the present invention.
Figure 14:
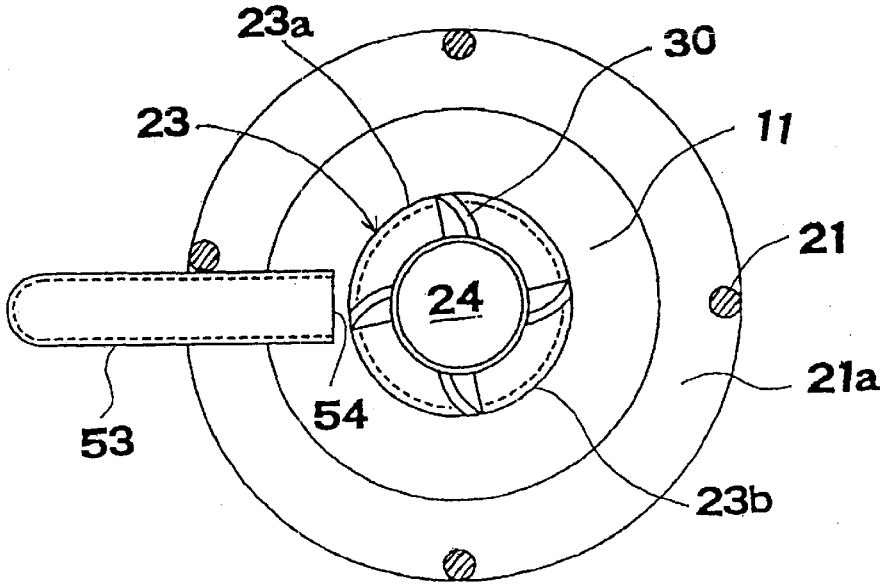
FIG. 14 is a bottom plan view of FIG. 13 as viewed from a line XIV—XIV in an arrow direction.

As shown in FIG. 13 and FIG. 14, an underwater agitation pump 50 according to this embodiment is characterized in that the underwater agitation pump 10 according to the first embodiment is further provided with a sub water supply pipe 53 which has an upper-end inlet opening 51 thereof opened in water by way of a strainer 52 and has a lower-end outlet opening 54 thereof disposed in the vicinity of the agitator 25 and directed toward the agitator 25. Here, constituents elements of the underwater agitation pump 50 which are identical with those of the underwater agitation pump 10 according to the first embodiment are indicated by same numerals. Further, in the drawing, numeral 55 indicates a mounting bracket for mounting the sub water supply pipe 53 to the underwater agitation pump 50.

Due to the above-mentioned constitution, the underwater agitation pump 50 according to this embodiment can obtain, in addition to the advantageous effect obtained by the underwater agitation pump 10 according to the first embodiment that the soil, sand or the like can be smoothly sucked and discharged even when the string-like material or the block-like material is mixed into the soil, sand or the like, an advantageous effect that even when the concentration of the soil, sand or the like is excessively high, the soil, sand or the like can be diluted by the sub water and then is agitated so that the soil, sand or the like can be smoothly sucked into the agitated material suction guide cylinder 23.

Fourth Embodiment

Figure 15:
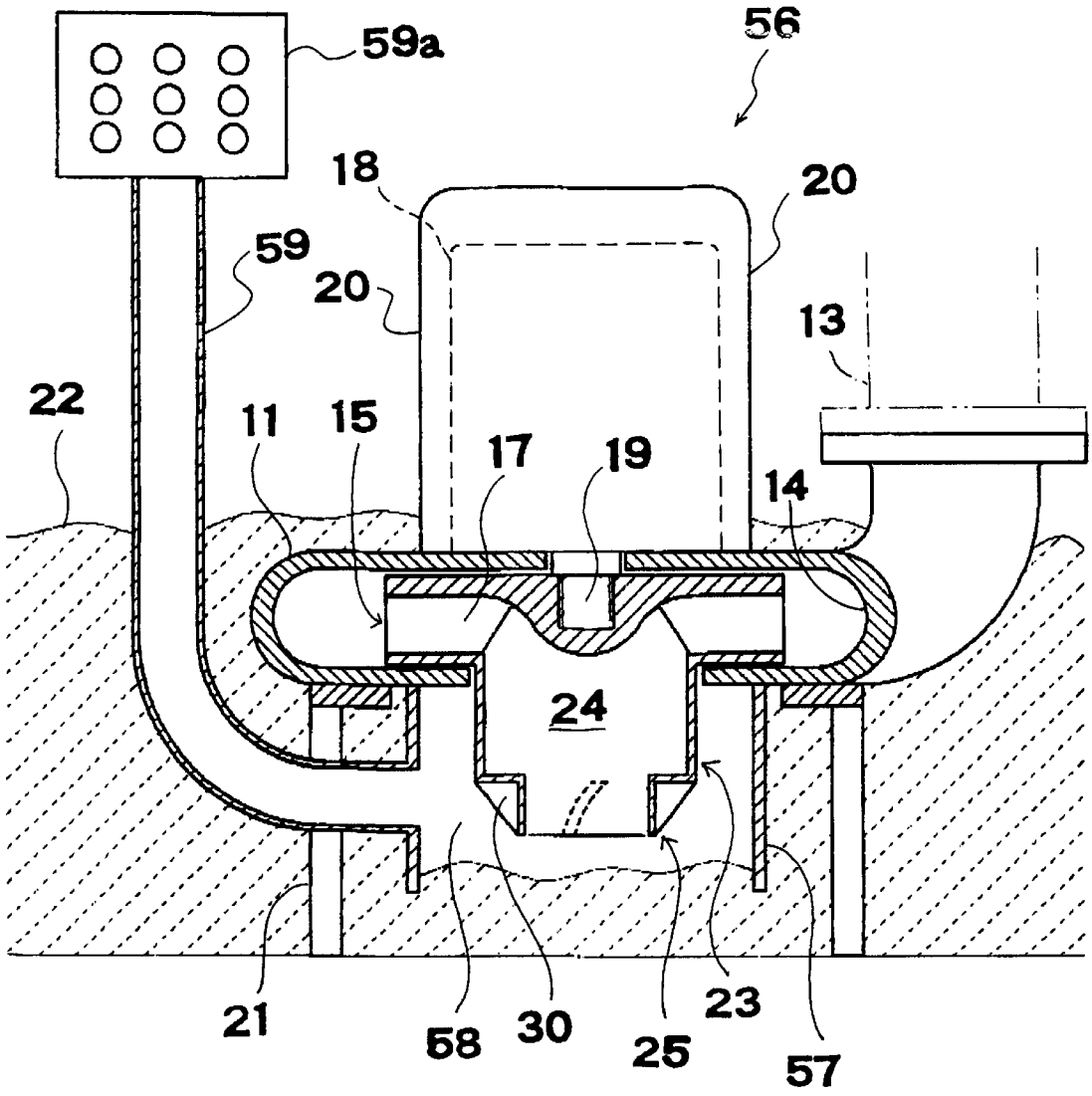
FIG. 15 is a front view with a part in cross section of an underwater agitation pump according to the fourth embodiment of the present invention.

An underwater agitation pump 56 according to this embodiment relates to a modification of an underwater agitation pump 10 according to the third embodiment. To be more specific, as shown in FIG. 15, a peripheral wall 57 for preventing collapsing and inflow of soil, sand or the like which concentrically surrounds the agitated material suction guide cylinder 23 and has a lower end thereof opened is contiguously connected to the lower portion of the impeller casing 11. The peripheral wall 57 may be preferably made of a solid wall having no apertures. A water reservoir space 58 is formed between the agitated material suction guide cylinder 23 and the peripheral wall 57 for preventing collapsing and inflow of soil. A sub water supply pipe 59 which has an upper-end inlet opening thereof opened in water by way of a strainer 59*a* has a lower-end outlet opening thereof communicably connected to the water reservoir space 58. Here, constituent elements of the underwater pump 56 which are identical with those of the underwater pump 10 according to the third embodiment are indicated by same numerals.

In this case, with the provision of the peripheral wall 57 for preventing collapsing and inflow of soil, sand or the like, at the time of starting the operation of the underwater agitation pump 56, it becomes possible to prevent the other-end opening portion of the agitated material suction guide cylinder 23 which forms the suction opening for the agitated material from being clogged by the collapsed soil, sand or the like. Simultaneously, with the provision of the water reservoir space 58, it becomes possible to make the soil, sand or the like having a high concentration smoothly flow into the inside of the agitated material suction guide cylinder 23 after diluting such soil, sand or the like with sub water.

Fifth Embodiment

Figure 16:
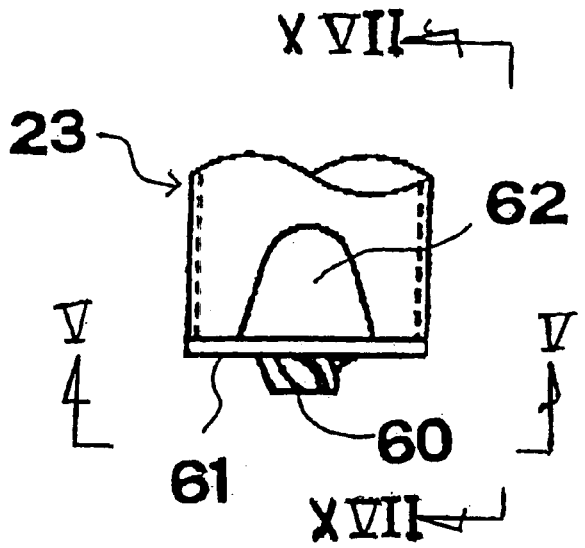
FIG. 16 is a front view of an agitator according to the fifth embodiment of the present invention.
Figure 17:
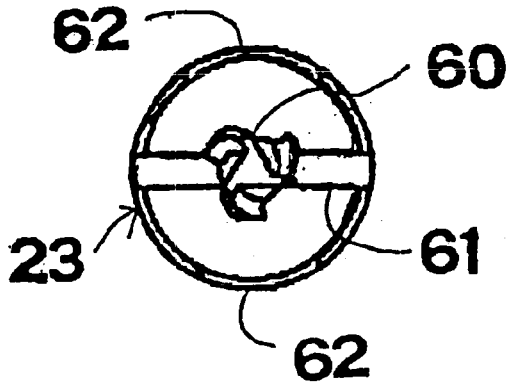
FIG. 17 is a bottom plan view of FIG. 16 as viewed from a line XVII—XVII in an arrow direction.
Figure 18:
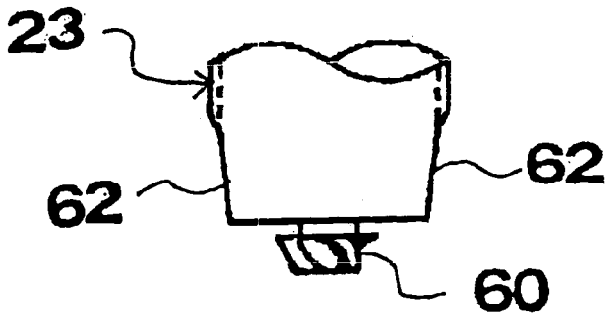
FIG. 18 is a side view of FIG. 16 as viewed from a line VII—VII in an arrow direction.
Figure 19:
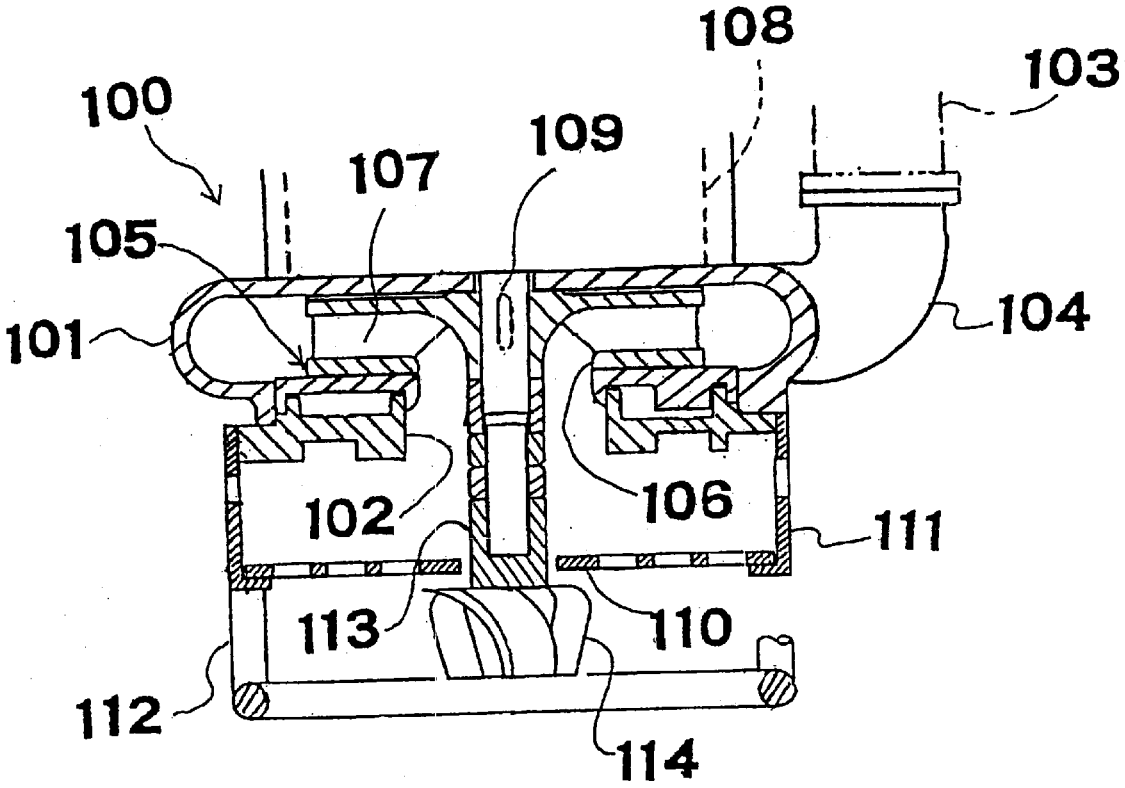
Fig.19 PRIOR ART
FIG. 19 is a cross-sectional front view of a conventional underwater agitation pump.
Figure 20:
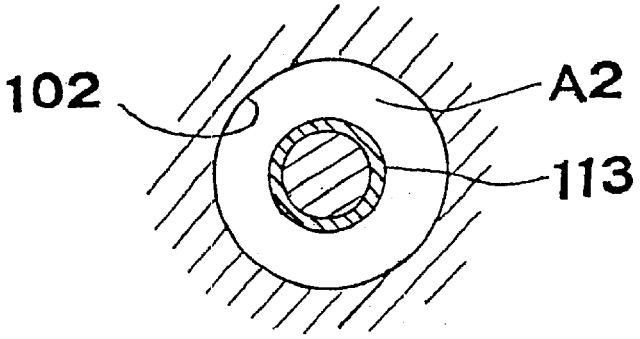
Fig.20 PRIOR ART
FIG. 20 is an explanatory view showing a soil/sand inflow effective area in a conventional underwater agitation pump.

An underwater agitation pump according to this embodiment relates to a modification of the underwater agitation pump 10 according to the first embodiment. To be more specific, as shown in FIG. 16 to FIG. 18, this embodiment is characterized in that an agitator 60 is arranged at a center portion of the other-end opening portion of the agitated material suction guide cylinder 23. That is, as shown in the drawings, a strip-like agitator mounting member 61 spans the other-end opening portion of the agitated material suction guide cylinder 23 and an agitator 60 is fixedly secured to a center portion of the agitator mounting member 61. Further, portions which constitute the other-end opening portion of the agitated material suction guide cylinder 23 and are disposed at both sides of the agitator mounting member 61 are notched toward the impeller 15 to form a pair of agitated material suction openings 62.

Also in this embodiment, the agitation of soil, sand or the like by the agitator 60 and the suction of the soil, sand or the like by the impeller 15 can be simultaneously performed so that the suction and discharge efficiency can be enhanced. Further, since a pair of agitated material suction openings 62 are formed at both sides of the agitator mounting member 61, the soil, sand or the like which contains the string-like material or the block-like material can be smoothly sucked into the impeller casing 11 through the agitated material suction openings 62 and thereafter can be discharged from the impeller casing 11 to a desired location.

Further, by providing a constitution in which the agitator 60 is detachably mounted on the agitator mounting member 61 by means of bolts or the like, when the agitator 60 is worn, the agitator 60 can be easily exchanged. Further, it is unnecessary to exchange the agitator 60 together with the agitated material suction guide cylinder 23 and it is sufficient to exchange only the agitator 60 and hence, the maintenance fee can be reduced.

As has been described heretofore, according to the present invention, following advantageous effects can be obtained.

(1) In the present invention, the proximal end of the agitated material suction guide cylinder which is formed of the hollow cylinder is directly communicably connected with the center suction opening portion of the impeller and the agitator is mounted on the outer peripheral portion of the distal end of the agitated material suction guide cylinder. Accordingly, it becomes possible to make the inner diameter of the agitated material suction guide cylinder substantially equal to the inner diameter of the center suction opening portion of the impeller and the agitator mounting shaft which has been necessary in the conventional underwater agitation pump is made unnecessary, whereby the agitated material suction passage formed in the inside of the agitated material suction guide cylinder can ensure a sufficiently wide agitated material inflow area. Accordingly, it becomes possible to sufficiently agitate soil, sand or the like in which block-like material or string-like material is mixed with the use of the agitator and, at the same time, it is possible to smoothly suck such soil, sand or the like in which the block-like material or the string-like material is mixed into the inside of the impeller casing through the agitated material suction guide cylinder.

(2) Since it becomes possible to make an outer diameter of the agitated material suction guide cylinder substantially equal to the inner diameter of the center suction opening portion of the impeller, compared to the agitator mounting shaft of the conventional underwater agitation pump which mounts the agitator on a distal end thereof, the outer diameter of the agitated material suction guide cylinder can be remarkably increased so that the winding or the wrapping of the string-like material around the agitated material suction guide cylinder can be reliably prevented.

(3) Compared to the agitator mounting shaft of the conventional underwater agitation pump, the outer diameter of the agitated material suction guide cylinder can be remarkably increased and hence, the section modulus can be remarkably increased so that the mechanical strength of the agitated material suction guide cylinder can be increased whereby it becomes possible to increase the agitator supporting strength and to prevent the rapture or the like of the agitated material suction guide cylinder reliably.

(4) Since the other-end opening portion of the agitated material suction guide cylinder which forms an suction opening of the agitated material is formed at a position which is downwardly protruded from the center suction opening portion of the impeller, such a suction opening can be located close to the waterbed compared to an agitated material suction opening of the conventional underwater agitation pump. Accordingly, it becomes possible to simultaneously perform the agitation and the suction of sediment (agitated material). In this manner, while ensuring the sufficiently wide agitated material inflow area in the inside of the agitated material suction guide cylinder, the suction efficiency of the sediment (agitated material) can be enhanced.

(5) In the present invention, the strip-like agitator mounting member which spans the other-end opening portion of the agitated material suction guide cylinder, the agitator which fixedly secured to the center portion of the agitator mounting member, and portions which constitute the other-end opening portion of the agitated material suction guide cylinder and are disposed at both sides of the agitator mounting member are notched toward the impeller to form a pair of agitated material suction openings. Accordingly, the agitation of soil, sand or the like by the agitator and the suction of the soil, sand or the like by the impeller can be simultaneously performed so that the suction and discharge efficiency can be enhanced.

(6) Further, along with the advantageous effect (5), since a pair of agitated material suction openings are formed at both sides of the agitator mounting member, the soil, sand or the like which contains the string-like material or the block-like material can be smoothly sucked into the impeller casing through the agitated material suction openings and thereafter can be discharged from the impeller casing to the desired location.

(7) Further, along with the advantageous effect (5), by providing the constitution in which the agitator is detachably mounted on the agitator mounting member by means of bolts or the like, when the agitator is worn, the agitator can be easily exchanged. Further, it is unnecessary to exchange the agitator together with the agitated material suction guide cylinder and it is sufficient to exchange only the agitator and hence, the maintenance fee can be reduced.

Although the inventions have been explained specifically in conjunction with several embodiments, the present inventions are not limited to the above-mentioned embodiments and includes other embodiments and modifications without departing from the scope of the inventions defined by scope of patent claims. For example, the drive source of the underwater agitation pump is not limited to an electrically-operated motor and includes a hydraulic motor or the like. Further, although the underwater agitation pump is arranged such that the whole underwater agitation pump is immersed in water in the above-mentioned embodiments, the invention includes the underwater agitation pump which has a portion thereof such as a drive source, for example, disposed above a water level. In this case, it is unnecessary to use a watertight motor. Still, further, the underwater agitation pump may be used not only in the vertical posture as described in the embodiments but also in the inclined posture or in the horizontal posture depending on the use conditions.

What is claimed is:

1. An underwater agitation pump comprising:

an impeller casing in which an impeller driven by a motor is rotatably accommodated, the impeller casing having a center opening at a center portion of a lower surface thereof and a discharge opening portion which is connected to a discharge pipe at a peripheral, portion thereof;

an agitated material suction guide cylinder being constituted of a hollow cylinder, the suction guide cylinder having one-end opening portion thereof integrally connected to a center suction opening portion of the impeller while passing through a center opening of the impeller casing the suction guide cylinder having the other-end opening portion thereof extended downwardly below the impeller casing; and an agitator which is mounted on an outer periphery of the other-end opening portion of the agitated material suction guide cylinder.

2. An underwater agitation pump according to claim 1, wherein the agitated material suction guide cylinder is formed with the impeller by an integral molding.

3. An underwater agitation pump according to claim 1, wherein the agitated material suction guide cylinder is formed as a body separate from the impeller and is connected to the impeller by means of bolts.

4. An underwater agitation pump according to claim 1, wherein the agitated material suction guide cylinder is formed as a body separate from the impeller, a female threaded portion is formed in the center suction opening portion of the impeller, a male threaded portion is formed in the one-end opening portion of the agitated material suction guide cylinder, and the agitated material suction guide cylinder is connected to the impeller by engaging the male threaded portion with the female threaded portion.

5. An underwater agitation pump according to claim 1, wherein the agitated material suction guide cylinder is comprised of a large-diameter body portion and a stepped distal-end narrowed-diameter portion which constitutes the other-end opening portion, and the agitator is formed by mounting a plurality of triangular agitator constituting members which are extended in the radial direction in a circumferentially spaced apart manner on a stepped portion of the stepped distal-end narrowed-diameter portion.

6. An under water agitation pump according to claim 1, wherein a helical feeding blade is mounted on an inner surface of the agitated material suction guide cylinder.

7. An underwater agitation pump according to claim 1, wherein a sub water supply pipe which has an upper inlet opening thereof opened in water has a lower outlet opening thereof disposed in the vicinity of the agitator and directed toward the agitator.

8. An under water agitation pump according to claim 1, wherein a peripheral wall for preventing collapsing and inflow of soil or sand which concentrically surrounds the agitated material suction guide cylinder and has a lower end thereof opened, is contiguously connected to a lower portion of the impeller casing, a water reservoir space is formed between the agitated suction guide cylinder and the peripheral wall for preventing collapsing and inflow of soil or sand, and a lower outlet opening of a sub water supply pipe which has an upper inlet opening thereof opened in water is communicably connected to the water reservoir space.

9. An underwater agitation pump comprising:

an impeller casing in which an impeller driven by a motor is rotatably accommodated;

an agitated material suction guide cylinder being constituted of a hollow cylinder which has one-end opening portion thereof integrally connected to a center suction opening portion of the impeller while passing through a center opening of the impeller casing and having the other-end opening portion thereof extended downwardly, the agitated material suction guide cylinder further forming an agitated material suction passage in the inside thereof;

a strip-like agitator mounting member which spans the other-end opening portion of the agitated material suction guide cylinder; and an agitator which is fixedly secured to a center portion of the agitator mounting member, wherein portions which constitute the other-end opening portion of the agitated material suction guide cylinder and are disposed at both sides of the agitator mounting member are notched toward the impeller to form a pair of agitated material suction openings.

* * * * *